United States Patent [19]

Schott

[11] 4,186,584

[45] Feb. 5, 1980

[54] TUBE EXPANDER

[75] Inventor: Donald E. Schott, Chester, Vt.

[73] Assignee: Thomas C. Wilson, Inc., Long Island City, N.Y.

[21] Appl. No.: 909,168

[22] Filed: May 24, 1978

[51] Int. Cl.[2] ..... B21D 39/06

[52] U.S. Cl. ..... 72/122; 72/125; 29/727

[58] Field of Search ..... 72/122, 125; 29/157.4, 29/157.5, 727

[56] References Cited

U.S. PATENT DOCUMENTS

| | | | |
|---|---|---|---|
| B 377,683 | 1/1975 | Martin | 72/122 |
| 260,555 | 7/1882 | Ferguson | 72/122 |
| 483,920 | 10/1892 | Henderer | 72/122 |
| 1,680,922 | 8/1928 | Wiedeke | 72/125 |
| 2,649,889 | 8/1953 | Dudley | 72/122 |
| 3,426,565 | 2/1969 | Schott | 72/122 |
| 3,906,771 | 9/1975 | Martin | 72/122 |
| 4,090,382 | 5/1978 | Schott | 72/119 |

*Primary Examiner*—Lowell A. Larson
*Attorney, Agent, or Firm*—Pennie & Edmonds

[57] ABSTRACT

A tube expander of the roller and mandrel type for expanding tubes within tube sheets having a housing assembly which includes a bearing mounted stop collar having a plurality of load-absorbing fingers provided with arcuate faces for limiting the axial position assumed by the tube relative to the tube sheet during the expansion of the tube. The arrangment includes a provision for predimensioning the portion of the tube which is ultimately to be exposed from the tube sheet whereby spacer members of selected thicknesses may be removed and installed on site.

14 Claims, 3 Drawing Figures

TUBE EXPANDER

BACKGROUND OF THE INVENTION

1. Field of the Invention

This invention relates to improvements in tube expanders of the roller and mandrel type which utilize a stop collar to restrain axial displacements of the tube to be expanded.

2. Description of the Prior Art

Various types of tube expanders of the roller and mandrel type for expanding tubes in tube sheets are known. In expanding thin-walled tubes having a wall thickness of approximately 22 gauge or thinner in tube sheets, it has been common to employ an expander which includes a tubular cage with slots containing rollers lying at an oblique angle to the axis of the cage and a tapered mandrel extending through the cage and movable into and out of contact with the rollers. When such an expander is inserted into a tube and the mandrel is advanced and rotated so as to force the rollers into contact with the tube, the movement of the mandrel causes the cage to rotate with the mandrel and to move into the tube. This movement of the cage continues until arrested by engagement with the tube sheet of a collar mounted on the cage to rotate therewith. The collar will generally have an internal radial shoulder opposed to the end of the tube for engagement therewith. During further rotation of the cage to complete the expansion of the tube, while movement of the cage into the tube is prevented, the rollers act to pull the tube outward from the sheet and into contact with the shoulder in the collar.

Under such arrangements, continued rotation of the cage will cause the rotating housing collar to mar the outer surface of the tube sheet around the end of the tube and to deform, curl or otherwise damage the end of the tube. Often the housing collar is unable to restrain thin-walled tubes since the outwardly directed forces are great enough to shear off the edge of the tube or suck the tube underneath the collar.

The difficulties are peculiarly applicable to thin-walled tubes in which the wall thickness of the tube after expansion is sufficiently thin to provide an extremely small contact area for use in offsetting the comparatively substantial traction forces tending to pull the tube out of the tube sheet. For example, in expansion of a tube of 22 gauge wall thickness, the outer diameter (O.D.) of the tube being approximately 0.875 inches, the actual dimension of the wall is approximately 0.028 inches, leaving a nominal inner diameter (I.D.) of approximately 0.819 inches. Assuming that the tube sheet opening is 0.890 inches, the tube must be expanded to 0.834 inches I.D. to achieve metal-to-metal contact, thus leaving approximately 0.020 inches of material on each side of the collar with which to bear against to offset the outward traction forces of the expansion rollers of the tube expander. In practice, it has been found that the magnitude of the traction forces, in comparison to the amount of tube material available to offset these forces, often causes the collar to be ineffective, with the result that the tube is sucked underneath the collar and totally destroyed.

Some attempts have been made in the past to provide the necessary anti-traction axial support forces while maintaining the desired axial dimension between the tube and tube sheet and avoiding marring or damaging forces to which the tube sheet and the tube would otherwise be subjected. In my U.S. Pat. No. 3,426,565 there is disclosed a tube expander of the roller and mandrel type which includes a relatively large and resilient thrust ring surrounding the expansion rollers while remaining in close contact with an end portion of a tube. The portion of the thrust ring which contacts the end portion of the tube exceeds the wall thickness of the tube end. As a result, the thrust ring distributes the axial load thereon without damaging the tube. Also, the thrust ring restrains axial displacement of the tube from the tube sheet. Although the thrust ring of my '565 patent has been found to be quite successful, it nevertheless has been found to be expensive to manufacture. In addition variations of the axial positioning of the end of the tube relative to the tube sheet are only accomplished by having available, thrust rings of various constructional dimensions, each corresponding to a predetermined amount of exposure which may be desired between the tube and tube sheet.

U.S. Pat. No. 3,924,433 to Martin relates to a tube expander of the roller and mandrel type, wherein a thrust collar limits outward advancement of a tube end which is received in a tube sheet. This thrust collar has a plurality of independently movable L-shaped wire fingers which contact the tube end. In use, these fingers develop relatively large stress localizations at the end of the tube, which stress localizations have been found to cause severe distortions to the end of the tube, particularly when the tube has a thin wall. In addition, the dimensions of the L-shaped wire fingers are fixed, thus fixing for any given collar, the dimension between the end of the tube and the tube sheet.

While these patents represent improvements in tube expanders of the type contemplated, they do not disclose expanders capable of readily limiting the axial position of an expanded tube within a tube sheet according to predetermined and readily selectable tube positions without causing damage to the end of the tube. I have invented a tube expander which not only accomplishes these ends, but provides an infinite number of positions for the tube relative to the tube sheet by a relatively simple and inexpensive arrangement.

SUMMARY OF THE INVENTION

The invention relates to an apparatus for expanding an end portion of a tubular member positioned within an opening defined by an outer member. The apparatus comprises a cage having one end portion adapted for insertion into one end portion of the tubular member, means mounted on the cage for expanding at least a part of the end portion of the tubular member outwardly into engaged relation with peripheral portions of the opening, and means rotatably movable within the cage for operatively engaging the expanding means to expand at least a part of the end portion of the tubular member and for developing traction forces which tend to displace the cage axially into the tubular member. The invention further comprises means disposed about the cage and adapted to engage the outer member to limit the axial displacement of the cage into the tubular member, and a stop collar disposed about the cage and having a plurality of individual members generally circumferentially positioned about the cage. Each member has an end portion which faces and engages the tubular member to limit axial displacement of the tubular member to a predetermined position relative to the outer member and is configured and dimensioned to distribute the limiting forces over the end of the tubular member without damaging the tubular member.

In the preferred arrangement the apparatus is adapted for expanding a thin walled tube within an opening of a tube sheet and includes an elongated cage having one end portion adapted to be inserted into one end portion of the tube, rollers mounted on the housing for rotation and outward radial movement for expanding the end of the tube outwardly into engaged relation with the wall of the opening, and means rotatably movable within the cage for operatively engaging the rollers to expand the end of the tube and for developing traction forces which tend to displace the cage axially into the tube. A housing is disposed about the cage and adapted to engage the tube sheet to limit movement of said cage into the tube causing the traction forces to tend to displace the tubular member outwardly from the outer member. A stop collar is disposed about the cage and connected to the housing and has a plurality of individual elongated members disposed circumferentially about the rollers in contacting relation therewith, each member having an enlarged end portion which faces and engages the end portion of the tubular member to provide axial forces thereagainst which limit axial displacement of the tube to a predetermined position relative to the outer member, the individual members being configured and dimensioned to distribute the axially directed forces over as much of the end of the tube as possible so as to avoid damaging the tube.

In the preferred embodiment the collar is of alloy tool steel construction and includes a base member from which the individual members extend for resilient pivotal movement radially toward and away from the axis of the apparatus. Each member preferably includes an enlarged head having an arcuate surface which tracks the expanding rollers as they move outwardly and a forward face which is arcuate and which forms collectively with the forward faces of the other members, an annular, or ring-like surface which faces the exposed end of the tube.

The housing is preferably of two-part threadedly assembled construction, with a washer-like spacer provided therebetween to selectively vary the length along the axial direction. With the stop collar being fixed in position relative to the axis of the housing, the spacer thus facilitates a unique adjustment of the dimension between the forward face of the housing which engages the tube sheet, and the forward face of the members which engage the tube. With such dimensional variation readily available, it will be appreciated that the length of the tube which is to be exposed from the tube sheet will readily be selected merely by adding or removing spacers. When all spacers are removed, the forward face of the housing becomes aligned with the forward faces of the members of the stop collar thus providing an arrangement in which the end of the expanded tube is flush with the surface of the tube sheet. When considering the construction of boilers, condensers, heat exchangers and the like, and the numerous requirements in the various constructions, such a convenient stop collar which is simple and economical to manufacture, will provide advantages previously unrealized to those skilled in the art. Further when considering the fact that thin walled tubes may vary in wall thickness from 0.028 inches or less, and tube materials may vary in strength from alloy steel to cupro-nickel, for example, an arrangement which provides almost immediate adaptability and selectivity will immediately be appreciated by those skilled in the art who have been accustomed to the cumbersome and potentially tube damaging arrangements presently available to them.

By tracking the rollers with the enlarged arcuate and segments of the individual members of the stop collar, alignment with the end of the tube is assured, particularly since in point of fact, the tube actually tracks the rollers as well. In addition, by dimensioning the end segments greater in thickness than the expected thickness of the thin walled tubes, the maximum distribution of axially directed tube limiting forces becomes available, thus avoiding distortions and destruction of the tubes and tube sheets. This factor alone represents an economical and time saving advantage.

BRIEF DESCRIPTION OF THE DRAWING

The preferred embodiment of the invention is described hereinbelow with reference to the sole drawing wherein.

DETAILED DESCRIPTION OF THE PREFERRED EMBODIMENT

Figure 1:
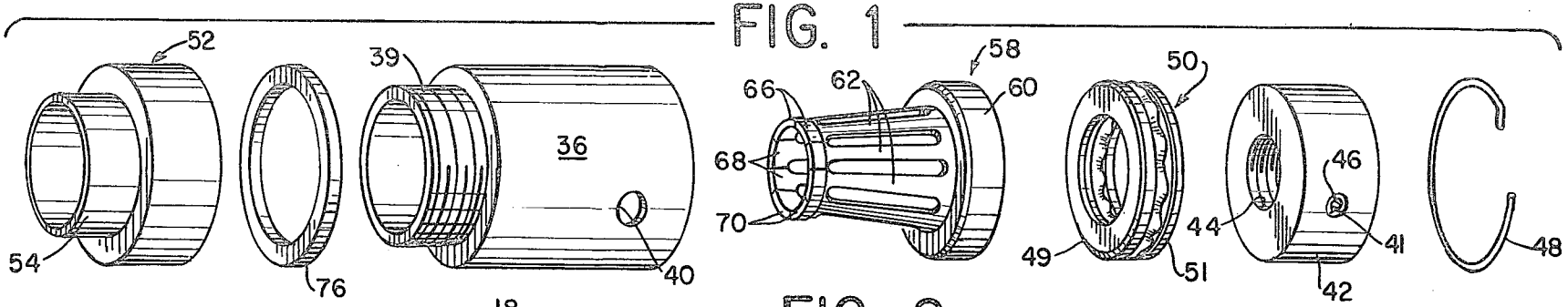
FIG. 1 is an exploded perspective view of the tube expander of the present invention.
Figure 2:
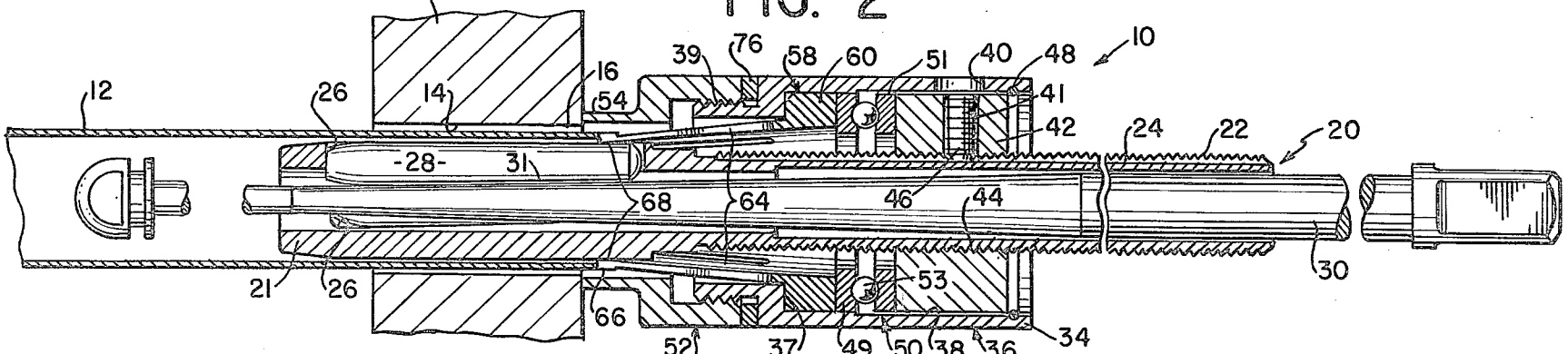
FIG. 2 is a view, partially in cross-section, of the tube expander of FIG. 1, assembled and positioned within an end portion of the tube to be expanded.

Referring to the drawing, FIGS. 1 and 2 illustrate a tube expander 10 of the present invention. In FIG. 2, the tube expander is shown in position to expand a thin-walled metal tube 12 into surface-to-surface engagement with wall 14 of opening 16 in metal tube sheet 18. The tube may be of any wall thickness, but the present invention is particularly useful for expanding tubes of 20 gauge or thinner, without distorting or marring the end of the tube.

Tube expander 10 includes an elongated tubular cage 20 having a forward section 21 and a rear externally threaded section 22. The threaded section has a longitudinally extending flat groove 24 formed in the threaded portion. Cage 20 has a cylindrical exterior surface of a diameter less than the inside diameter of the tube 12. Longitudinally extending slots 26 are formed through the wall of the forward tubular section 21 of cage 20 and are circumferentially spaced thereabout with respect to each other. Slots 26 have their longitudinal axes skewed at an acute angle relative to the longitudinal axis of cage 20. A tube expansion roller 28 is positioned and retained for rotation within each slot. Since slots 26 are skewed, the tube expansion rollers 28 are likewise skewed or canted. Tube expansion rollers 28 are fabricated of hardened tool steel and have a tapered central section with the large end at the forward end of the cage. The tube expansion rollers 28 are retained within the slots 26 of the cage 20 by peening over the outer edges of the slots and they are retained in the slots in such fashion that they are free to rotate and to move in a generally radial direction.

A tapered mandrel 30 has a tapered conical exterior surface 31 over the portion of its length which is movable into and out of contact with the tube expansion rollers 28. Surface 31 tapers gradually toward its forward end in a direction opposite the taper of the rollers 28. Interaction of the tapered mandrel 30 and tube expansion rollers 28 results in expansion of the radial path of the rollers 28 which, in turn, expands tube 12. Such interaction also produces inward traction forces directed axially of the tube which tend to move cage 20 and tube expansion roller 28 into tube 12 while expanding tube 12 toward a metal-to-metal contacting condition with the wall of opening 72.

Figure 3:
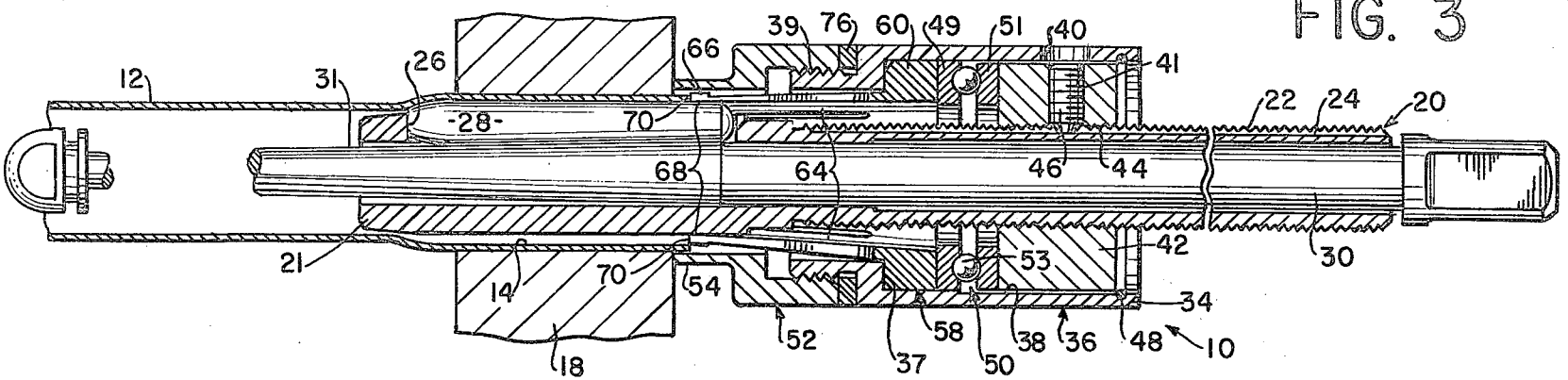
FIG. 3 is a view, partially in cross-section, of the tube and tube expander of FIG. 2 after completion of expansion of the tube.

Referring now to FIGS. 2 and 3, housing 36 includes a cylindrical section 34 having a central bore 38, inner shoulder 37, threaded shank 39 and sidewall opening 40. The housing includes a cylindrical nose-piece 52 which is threadedly secured to the shank 39. The forward end 54 of nose-piece 52 is cylindrical and dimensioned to contact tube sheet 18 to arrest inward movement of the tube expander 10 into tube 12.

Stop collar 58 is positioned within housing 36 and has an enlarged base 60 which is retained between inner shoulder 37 and forward race 49 of thrust bearing 50. Stop collar 58 is of integral construction and includes a plurality of independently movable and circumferentially disposed fingers 62 which extend from the base 60. Each finger 62 has an intermediate central section 64 and an enlarged segment 66 which has an arcuate inner face 68 and an arcuate forward face 70 which faces tube 12 when the apparatus is positioned to expand tube 12. The base 60 and fingers 62 of stop collar 58 are preferably constructed of alloy tool steel which possesses resilience and sufficient compressive and buckling strength to withstand the axial forces placed on the fingers 62, which forces in some instances are in excess of 1,500 pounds.

Referring once again to the drawings, bearing 50 includes rearward race 51 spaced from forward race 49 by bearing balls 53. Thrust nut 42 has an outer diameter less than the diameter of bore 38 and an internally threaded central opening 44 for threaded reception of the rear externally threaded section 22 of cage 20. The thrust nut 42 includes a radial threaded opening 41 which threadedly receives set screw 46, adjustment of which is made possible through sidewall opening 40 of housing 36. Retaining ring 48 is positioned in a groove formed in central bore 38 of housing 36 to retain the stop collar 58, bearing 50, and thrust nut 42 assembled within housing 36. The position of the housing assembly relative to the rear threaded section 22 of cage 20 is generally determined by the thickness of the tube sheet 18. Repositioning of the housing assembly in an axial direction along the rear threaded section 22 of cage 20 is facilitated by and rotating housing 36 until the access opening 40 becomes aligned with the set screw 46. Set screw 46 is then withdrawn from groove 24 to permit rotation and axial adjustment of the housing assembly, after which the set screw may be aligned with groove 24 and secured to fix the position of the housing assembly in the location selected.

As shown in FIG. 1, fingers 62 are in their normal unloaded positions and converge toward the longitudinal axis of the stop collar 58 such that each end segment 66 abuts the adjacent end segment. Thus, when stop collar 58 is positioned within cylindrical body 36 and secured in position, as shown in FIG. 2, the arcuate faces 68 of the end segments 66 normally rest upon the expansion rollers 28 and as the rollers move radially outwardly during expansion, the end segments move outwardly with the rollers in tracking relation therewith while progressively increasing their circumferential spacing.

A significant feature of the stop collar 58 resides in the provision of the arcuate forward faces 70 of end segments 66 which are preferably of greater thickness than the wall thickness of the tube 12 to ensure maximum surface-to-surface contact between the faces 70 of the fingers 62 of stop collar 58 and the open end of tube 12. Thus, before expansion of the end of tube 12, the inner diameter of the circular configuration collectively formed by the end segments 66 may be less than the inner diameter of tube 12 and the outer diameter formed by end segments 66 may be greater than the outer diameter of tube 12 as shown in FIG. 2. As the tube expansion progresses, each finger 62 of collar 58 tracks the rollers 28 independently of the others as the rollers move radially outward. Ultimately, the fingers 62 engage the end of the tube 12 and act collectively as a barrier against further advance by the tube.

The operation of the tube expander is described in connection with the expansion of tube 12 within opening 16 defined by the tube sheet 18 as shown in FIGS. 2 and 3. In FIG. 2, tube 12 is adjustably positioned loosely within opening 16 of tube sheet 18 so that the front end of the tube 12 either lies flush with the outside surface of the sheet or projects a predetermined amount as shown. The position of housing 36 and assembled components is then adjusted along cage 20 by rotation about the rearward threaded section 22 to a position determined by the thickness of the tube sheet 18.

The cage 20, with the mandrel 30 in position, is then inserted into the tube and the mandrel 30 is rotated and simultaneously moved forwardly into the cage 20. When the rollers are brought into contact with the inner surface of the tube 12, the rotation of the mandrel causes the rollers to roll along the inner surface of the tube 12 and to rotate the cage 20. The skewing of the rollers causes the cage to be drawn into the tube and this movement continues until the forward end 54 of nose-piece 52 comes into contact with the tube sheet 18. Further rotation of the cage then tends to pull the tube 12 outward through the sheet 18 but such movement of the tube 12 is arrested by engagement of the projecting end of the tube with the forward faces 70 of the end segments 66. Since the thickness of the faces 70 of the end segments 66 is greater than the wall thickness of the tube, the tube is fully supported at its end with the limiting forces therebetween being distributed over a maximum area of the end of the tube 12.

Because of thrust bearing 50, the rollers cause no rotational movement of the stop collar 58. Thus, there is no action or movement tending to deform the exposed end of the tube 12 when it is pulled into contact with the stop collar 58. However, the fingers 62 of the stop collar 58 move pivotally outward and the end segments 66 follow the radial movement of rollers 28. Each segment 66 actually tracks independently, the expansion of the tube 12 while progressively increasing the circumferential space between adjacent end segments 66. When the end segments 66 finally engage the end of tube 12, they provide uniform and distributed stop forces over the exposed face of the tube. When the expansion of the tube is completed as shown in FIG. 3, the mandrel 30 is rotated in the reverse direction and the cage 20 and mandrel 30 are withdrawn from the tube. The fingers 62 of stop collar 58 then return to the original unloaded position due to their resilient character.

A significant feature of the present arrangement resides in the provision of a spacer (or spacers) 76 between cylindrical housing 36 and threaded nose-piece 52 which may be varied in thickness to vary the axial dimension between the forward faces 70 of the enlarged end segments 66 of fingers 62 of collar 58 and the forward face of the forward end 54 of forward housing section 52. By varying the thickness of the spacer 76, the precise dimension of the portion of tube 12 which will project from the tube sheet 18 may be pre-selected. Accordingly, when the tube 12 is positioned within the tube sheet opening 16, it will only be necessary to approximate the length of the portion to be exposed, since the length of the ultimate exposed portion of tube 12 will be precisely determined by the relative positions of the forward face of the forward end 54 of nose-piece 52 and the forward faces 70 of end segments 66. Thus, if prior to expansion the tube extends out of the tube sheet more or less than the desired distance, during the expansion process the tube will assume the correct position automatically through the action of the respective engagements of the forward end 54 of nose-piece 52 and the fingers 62 of stop collar 58.

If necessary or desirable, the spacer 76 may be eliminated completely whereby the nose-piece 52 will be fully threaded onto cylindrical housing 36 whereby the respective forward surfaces of both the nose-piece 54 and the stop collar 58 will be in aligned relation. Thus structural arrangement will result in final expansion of tube 12 against the opening 16 of the tube sheet 18 with the respective axial aligning forces causing the end of the tube 12 to assume a position in which the end of the tube is flush with the surface of the sheet 18.

I claim:

1. An apparatus for expanding an end portion of a tubular member positioned within an opening defined by an outer member, which comprises:

(a) a cage having one end portion adapted for insertion into one end portion of the tubular member;

(b) means mounted on said cage for expanding at least a part of the end portion of the tubular member outwardly into engaged relation with peripheral portions of the opening;

(c) means rotatably movable within said cage for operatively engaging said expanding means to expand at least a part of the end portion of the tubular member and for developing traction forces which tend to displace said cage axially into the tubular member;

(d) means disposed about said cage and adapted to engage the outer member to limit the axial displacement of said cage into said tubular member; and (e) a stop collar disposed about said cage and having a plurality of individual members generally circumferentially positioned about said cage, each member having an end portion which faces and engages the tubular member to limit axial displacement of the tubular member to a predetermined position relative to the outer member and configured and dimensioned to distribute the limiting forces over the end of the tubular member without damaging the tubular member.

2. The apparatus according to claim 1, wherein the end portion of at least certain of said individual members has a surface which faces the end of the tubular member and has a generally arcuate configuration.

3. The apparatus according to claim 2, wherein said stop collar is of integral construction.

4. The apparatus according to claim 3, wherein said housing is comprised of two sections, a first generally cylindrical rear section and a forward section threadedly securable to said rear section and having a forward face dimensioned and positioned to engage said outer member to limit entry of said cage into the tubular member.

5. The apparatus according to claim 4, wherein at least one spacer is positioned between said rear and forward housing sections, said spacer member being dimensioned to selectively determine the dimension between the forward face of said forward housing section and the arcuate surfaces of said stop collar.

6. The apparatus according to claim 5, wherein said arcuate end portions of said individual members collectively form a surface having a circular configuration which corresponds generally to the end portion of the tubular member.

7. The apparatus according to claim 6, wherein the circular surface position of said collective individual members has a thickness which exceeds the radial thickness of the end portion of the tubular member.

8. The apparatus according to claim 7, wherein each of said individual members has a generally elongated central portion and a relatively enlarged end portion which faces the tubular member.

9. The apparatus according to claim 8, wherein said stop collar is constructed of metal material.

10. The apparatus according to claim 9, wherein said metal material is alloy tool steel.

11. An apparatus for expanding an end portion of a tubular member positioned within an opening defined by an outer member, which comprises:

(a) an elongated cage having one end portion adapted to be inserted into one end portion of the tubular member;

(b) roller means mounted on said housing for rotation and outward radial movement for expanding at least a part of the end portion of the tubular member outwardly into engaged relation with peripheral portions of the opening;

(c) means rotatably movable within said cage for operatively engaging said roller means to expand at least a part of the end portion of the tubular member and for developing traction forces which tend to displace said cage axially into the tubular member;

(d) housing means disposed about said cage and adapted to engage the outer member to limit movement of said cage into the tubular member causing said traction forces to tend to displace the tubular member outwardly from the outer member;

(e) a stop collar disposed about said cage and connected to said housing and having a plurality of individual members generally circumferentially disposed about said roller means in contacting relation therewith, each member having an end portion which faces and engages the end portion of the tubular member to provide axial forces thereagainst which limit axial displacement of the tubular member to a predetermined position relative to the outer member, said individual members being configured and dimensioned to distribute the axial forces over the end of the tubular member without damaging the tubular member.

12. In the apparatus for expanding an end portion of a thin-walled tube positioned within an opening of a tube sheet, the combination of a generally elongated cage having a forward section having a plurality of openings extending through its wall and a rearward externally threaded section, rollers mounted in the openings, a tapered mandrel extending through the cage for contact with the rollers, a housing encircling the cage and adjustable to and from a position which overlies the rollers, said housing having a forward section adjustably secured thereto and having a forward end dimensioned for engagement with the tube sheet, a stop collar positioned within the housing and defining a plurality of individual members generally circumferentially positioned about said cage and dimensioned and configured for continuous surface tracking contact with the rollers, each of said individual members having a forward surface portion having a generally arcuate configuration and positioned to face the end of the tube, a bearing positioned in engagement with the rear portion of the stop collar, a nut threadedly disposed about the rearward threaded section of said cage and positioned within said housing in engagement with said bearing to provide adjustability of the positions of said housing relative to said cage, retaining means to retain said stop collar and bearing in assembled relation with said housing such that positioning said cage and said rollers within the end portion of the tube and rotatably moving said mandrel into said cage in engagement with said rollers, the rollers rotatably move generally outwardly against the inner surface of the end portion of the tube causing at least a part of the end portion of the tube to be expanded into engagement with the tube sheet while developing traction forces which tend to move said cage inwardly of the tube until the forward end of said forward housing section engages the tube sheet and causes the traction forces to tend to move the tube outwardly of the tube sheet, and said arcuate forward surface portions of said individual members of said stop collar collectively limit movement of the tube outwardly of the tube sheet while distributing the limiting axial forces over the end of the tubular member without damaging the tubular member.

13. In an apparatus for expanding an end portion of a thinwalled tube positioned within an opening of a tube sheet, the combination of a generally tubular cage having a forward section defining a plurality of generally elongated openings extending through its wall, and a rearward externally threaded section, rollers mounted in the openings, a tapered mandrel extending through the cage for contact with the rollers, a housing encircling the cage and adjustable to and from a position which overlies the rollers, said housing including a forward portion adjustably secured thereto, said forward portion having a forward end dimensioned for engagement with the tube sheet, a stop collar positioned within the housing and defining a plurality of individual members, each having a forward surface portion having a generally arcuate configuration and positioned to face the end of the tube, a thrust bearing positioned adjacent the rear portion of the stop collar and in engagement therewith, a nut threadedly disposed about the rearward threaded section of said cage and within said housing in engagement with said bearing to provide selective adjustment of the position of said housing relative to said cage, means to retain said housing, said stop collar, said thrust bearing and said nut in assembled relation such that positioning said cage and said rollers within the end portion of the tube and rotatably moving said mandrel into said cage while in engagement with said rollers, the rollers rotate and move generally outwardly causing at least a part of the end portion of the tube to be expanded into engagement with the tube sheet while developing traction forces which tend to move the cage inwardly of the tube until said forward housing section engages the tube sheet whereby said traction forces tend to move the tube outwardly of the tube sheet a predetermined distance until the tube engages the forward arcuate surface portions of the individual members of said stop collar, thus preventing further movement of the tube outwardly of the tube sheet by distributing the limiting stop forces over a substantial portion of the surface of the end of the tube thereby avoiding damage to the end of the tube.

14. In a tube expander, the combination of a generally tubular cage having a forward section defining a plurality of openings through its wall and a rearward externally threaded section, tapered rollers mounted in the openings and disposed at an acute angle relative to the axis of the cage, a mandrel extending through the cage for contact with the rollers and having a taper generally opposite the taper of the rollers, a housing disposed about the cage and adjustable to and from a position which overlies the rollers, said housing having a forward section having a forward face dimensioned for engagement with the tube sheet, a spacer member disposed between the forward and rearward housing sections to selectively adjust the length of the housing, a stop collar positioned within the housing and having a base member and a plurality of individual elongated members constructed integrally with the base member and having enlarged end portions disposed in adjacent engaged relation, each end portion having a generally arcuate forward surface to form collectively with the corresponding surface portions of the other end portions a generally continuous, generally circular forward surface which faces the tube to be expanded, each member being connected to said base member for outward pivotal resilient movement toward and away from their rest positions, a ball type thrust bearing positioned in adjacent engaged relation with the base member of the stop collar, a nut threadedly disposed about the rearward threaded section of said cage and within said housing in engagement with said thrust bearing to provide selective adjustment of the axial positions of said housing relative to said cage, a retaining ring disposed within said housing to retain said housing in assembled relation with said stop collar and said thrust bearing and said nut, the forward arcuate surface portions of said individual members of said stop collar being capable of engaging the end portion of the tube to limit movement of the tube outwardly of the tube sheet during expansion thereof as determined by the axial dimension between the arcuate forward surface portions of said individual members of said stop collar and the forward face of the forward housing section as determined by the thickness of said spacer.

* * * * *